US006520803B1

(12) United States Patent
Dunn

(10) Patent No.: US 6,520,803 B1
(45) Date of Patent: Feb. 18, 2003

(54) CONNECTION OF SHIELDS IN AN ELECTRICAL CONNECTOR

(75) Inventor: Thomas W. Dunn, Flinton, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/054,663

(22) Filed: Jan. 22, 2002

(Under 37 CFR 1.47)

(51) Int. Cl.[7] ..... H01R 13/648
(52) U.S. Cl. ..... 439/608
(58) Field of Search ..... 439/608, 607, 439/609, 610, 701

(56) References Cited

U.S. PATENT DOCUMENTS

| | | | | | |
|---|---|---|---|---|---|
| 5,288,248 | A | | 2/1994 | Chen | 439/609 |
| 5,479,321 | A | | 12/1995 | Mair et al. | 361/816 |
| 5,730,609 | A | * | 3/1998 | Harwath | 439/608 |
| 5,738,544 | A | | 4/1998 | Davis | 439/607 |
| 5,954,540 | A | | 9/1999 | Wu | 439/607 |
| 6,139,366 | A | | 10/2000 | van Woensel | 439/609 |
| 6,139,367 | A | | 10/2000 | Yeh | 439/609 |
| 6,168,466 | B1 | | 1/2001 | Chiou | 439/607 |
| 6,168,467 | B1 | | 1/2001 | Chiou | 439/607 |
| 6,203,373 | B1 | | 3/2001 | Lin | 439/607 |
| 6,206,730 | B1 | | 3/2001 | Avery et al. | 439/609 |
| 6,210,228 | B1 | | 4/2001 | Simmel et al. | 439/609 |
| 6,210,229 | B1 | | 4/2001 | Lai | 439/610 |
| 6,231,392 | B1 | | 5/2001 | van Woensel | 439/610 |
| 6,299,484 | B2 | * | 10/2001 | Van Woensel | 439/608 |
| 6,354,877 | B1 | * | 3/2002 | Shuey et al. | 439/608 |
| 6,361,374 | B1 | * | 3/2002 | Lloyd et al. | 439/608 |

OTHER PUBLICATIONS

"PCB Mounted Receptacle Assembly" Part No. 73981, Metral 1000 Series Interactive Product Catalog, FCI Inc., 1 page.

"PCB Mounted Header Assembly" Part No. 73983, Metral 1000 Series Interactive Product Catalog, FCI Inc., 1 page.

* cited by examiner

*Primary Examiner*—Gary Paumen
(74) *Attorney, Agent, or Firm*—Harrington & Smith, LLP

(57) ABSTRACT

A receptacle electrical connector including electrical contacts connected to housing members, at least one interior shield member located between the housing members, and an exterior shield member electrically connected to the at least one interior shield member at a connection. The connection includes the interior and exterior shield members having a recess and a cantilevered deflectable hook adapted to be inserted into the recess. The hook includes a receiving area and a groove extending towards the receiving area on an exterior side of the hook. The groove is adapted to guide a projection into the receiving area as the interior and exterior shield members are attached to each other.

20 Claims, 5 Drawing Sheets

CONNECTION OF SHIELDS IN AN ELECTRICAL CONNECTOR

BACKGROUND OF THE INVENTION

1. Field of the Invention

The present invention relates to electrical connectors and, more particularly, to an electrical connector having shield members connected to each other.

2. Brief Description of Prior Developments

FCI USA, Inc. manufacturers and sells a printed circuit board mounted receptacle assembly under the trademark Metral™. The receptacle assembly is adapted to mate with a printed circuit board mounted pin header assembly. The Metral™ receptacle assembly is an impedance controlled connector manufactured by assembling a number of individual components. The components include plastic housing pieces, stamped and overmolded metal contacts, a bottom shield, a top shield, and vertical shields. The bottom shield, top shield and vertical shields form an integral ground plane system that, in part, establishes the signal integrity characteristics of the connector. Contact fingers of the ground shield directly interface with ground pins of the mating header. The top shield wraps around the top of the connector and down over the back side. The vertical shields are positioned between contact columns in the housing pieces. These vertical shields extend from the front of the connector to the back. All three shields have press fit tails that terminate to the printed circuit board.

The top shield and vertical shields in the Metral™ receptacle connector are connected mechanically and electrically by a series of metal latches. The metal latch system is comprised of a series of J hook shaped beams (formed in the top shields) that interlock with edges of the vertical shields. The top shield latches with receiving areas on the top and back edges of each vertical shields. The latches provide an electrical path between shields for ground currents. The latches fasten the top shield to the assembly and contribute to the mechanical integrity of the assembly.

SUMMARY OF THE INVENTION

In accordance with one aspect of the present invention, a receptacle electrical connector is provided including electrical contacts connected to housing members, at least one interior shield member located between the housing members, and an exterior shield member electrically connected to the at least one interior shield member at a connection. The connection includes the interior and exterior shield members having a recess and a cantilevered deflectable hook adapted to be inserted into the recess. The hook includes a receiving area and a groove extending towards the receiving area on an exterior side of the hook. The groove is adapted to guide a projection into the receiving area as the interior and exterior shield members are attached to each other.

In accordance with another aspect of the present invention, an electrical connector is provided comprising contact modules comprising electrical contacts connected to housing members, first shield members and a second shield member. The first shield members are located between at least some of the contact modules. The second shield member is connected to an exterior side of the contact modules. The second shield member comprises deflectable latches extending into recesses in the first shield members. Each latch comprises a general J shape with a receiving area at an end of the latch and a groove extending towards the receiving area. Each of the first shield members comprise a projection located in one of the latch receiving areas. The grooves guide the projections into the latch receiving areas as the first and second shield members are attached to each other.

In accordance with one method of the present invention, a method of assembling an exterior shield with an interior shield in an electrical connector assembly is provided comprising steps of inserting a deflectable latch of the exterior shield into a recess in a side edge of the interior shield; guiding the latch along a predetermined path into the recess, the step of guiding comprising a groove on the latch sliding along a portion of the interior shield; and locating the portion of the interior shield in a receiving area of the latch. The receiving area is located at an end of the groove.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
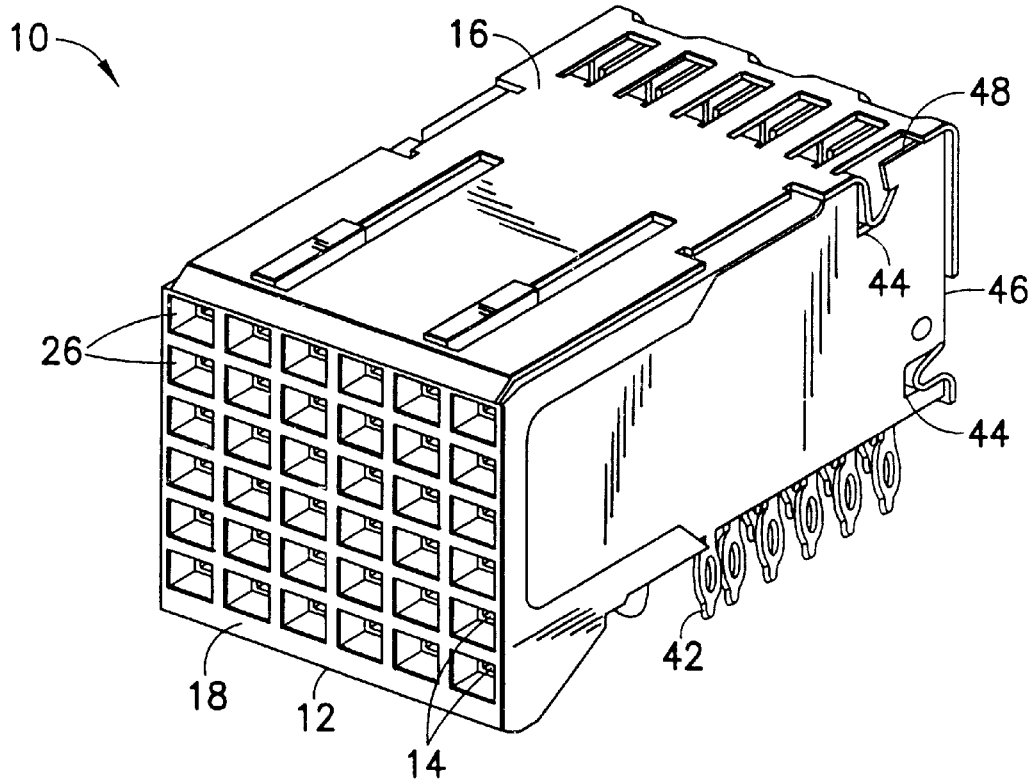
FIG. 1 is a top, front, left side perspective view of an electrical connector incorporating features of the present invention.

Referring to FIG. 1, there is shown a perspective view of an electrical connector 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 3:
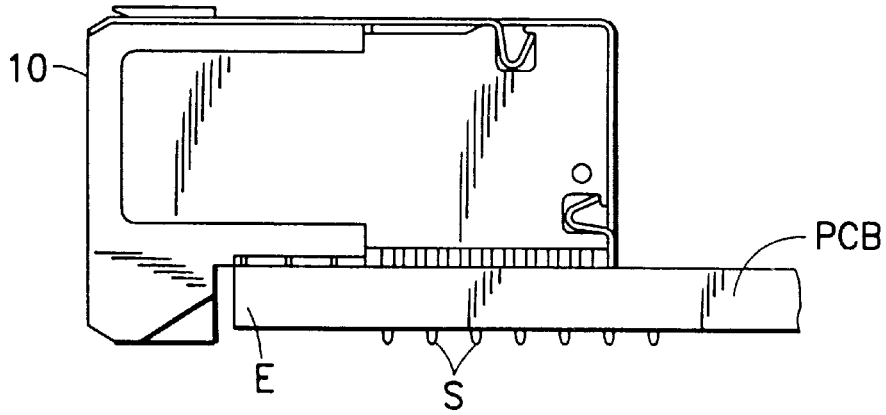
FIG. 3 is a left side elevational view of the connector shown in FIG. 1 shown attached to a printed circuit board.

The connector 10, in the embodiment shown, is a receptacle electrical connector adapted to removably mate with a pin header connector. However, in alternate embodiments, features of the present invention could be incorporated into any suitable type of electrical connector having multiple shield members which are attached to each other. As shown in FIG. 3, the connector 10 is adapted to be fixedly connected to a printed circuit board PCB at a side edge E of the board. However, in alternate embodiments, the connector could be adapted to be connected to any other suitable type of component and could be connected to the component at any suitable type of location. In the embodiment shown, the connector 10 comprises through-hole solder tails S which extends through holes in the printed circuit board. However, in alternate embodiments, the connector 10 could be mounted to the printed circuit board in any suitable type of fashion, such as with surface mounting tails.

Figure 2:
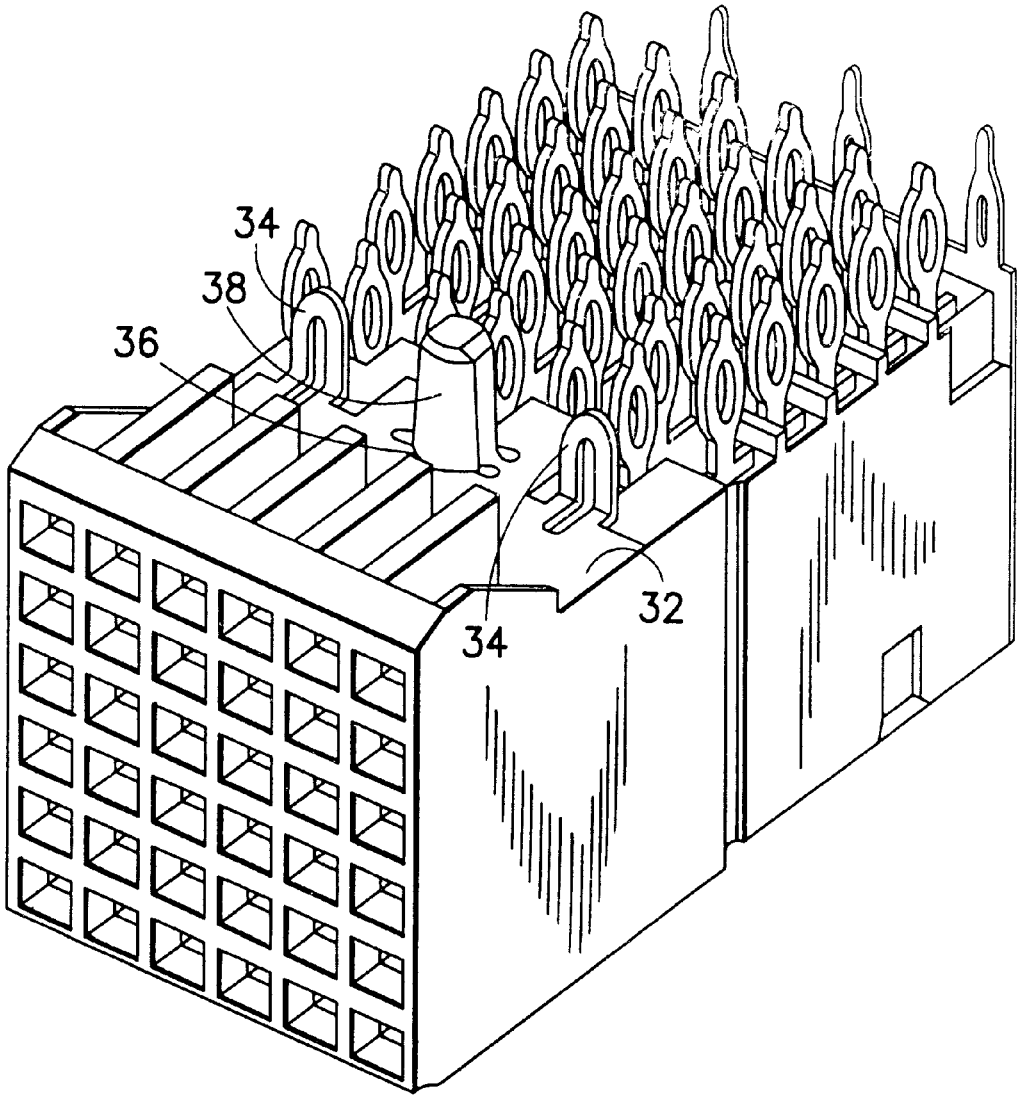
FIG. 2 is a bottom, front, right side perspective view of the electrical connector shown in FIG. 1.
Figure 4:
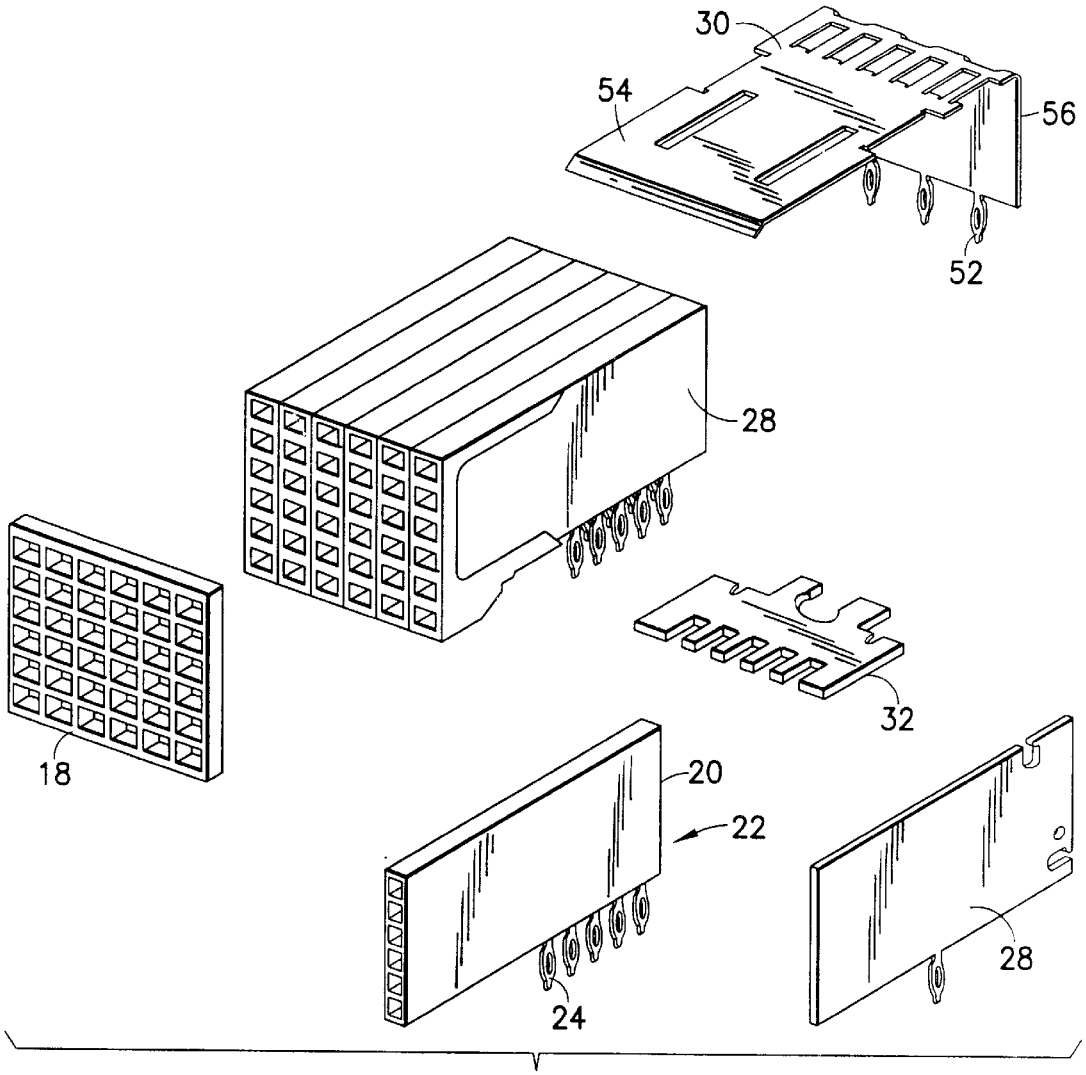
FIG. 4 is an exploded perspective view of the electrical connector shown in FIG. 1.

Referring also to FIGS. 2 and 4, the connector 10 generally comprises a housing 12, electrical contacts 14, and a shield 16. In alternate embodiments, the connector could comprise additional or alternative components. The housing 12 generally comprises a front housing member 18 and a plurality of contact module housings 20. The contact module housings 20 are preferably overmolded onto the electrical contacts 14 to form contact modules 22. However, in an alternate embodiment, the contact modules housing 20 might not be overmolded onto the electrical contacts. The electrical contacts 14 have contact receiving areas located inside each housing 20, and through-hole solder tails 24 which form the solder tails S shown in FIG. 3.

The front housing member 18 comprises an array of holes 26. The contact modules 22 are connected to the rear side of the front housing member 18. The contact modules 22 comprised front facing male contact receiving holes which are aligned with the array of holes 26 in the front housing member 18. Thus, male contacts, such as pins in a pin header, can be inserted through the holes 26 into the contact modules 22 to make a removable electrical connection with the electrical contacts 14.

The shield 16, in the embodiment shown, generally comprises first shield members 28, a second shield member 30, and a third shield member 32. The shield members 28, 30, 32 are preferably comprised of metal, such as sheet metal. However, in alternate embodiments, the shield members could be comprised of any suitable type of material(s). The first shield members 28 form vertical interior shield members for the connector 10. In the embodiment shown, one of the first shield members 28 is located at the left exterior lateral side of the assembly. However, the right exterior lateral side of the assembly does not comprise one of the vertical shields 28. In alternate embodiments, the exterior lateral sides could both comprise one of the vertical shields or, alternatively, neither exterior lateral side might comprise one of the vertical shields.

The vertical shield members 28 have a general flat planar shape. However, in alternate embodiments, the vertical shield members could comprise any suitable type of shape. In addition, in an alternate embodiment, the first shield members 28 might be orientated in a plane other than a vertical plane. The contact modules 22 also have a general flat shape. The contact modules 22 are aligned in parallel planes next to the vertical shields 28. In the embodiment shown, the vertical shields 28 are sandwiched between pairs of the contact modules 22. Thus, the contact modules 22 and first shield members 28 are assembled in an alternating sandwich configuration.

The third shield member 32 forms a bottom shield for the connector 10. As seen best in FIG. 2, the third shield member 32 comprises mounting posts 34 and a hole 36 for a mounting post 38 of the front housing piece 18 to extend through. However, in alternate embodiments, any suitable type of bottom shield could be provided. In one type of alternate embodiment, the bottom shield might not be provided or the bottom shield could be provided integral with the second shield member 30.

Figure 6:
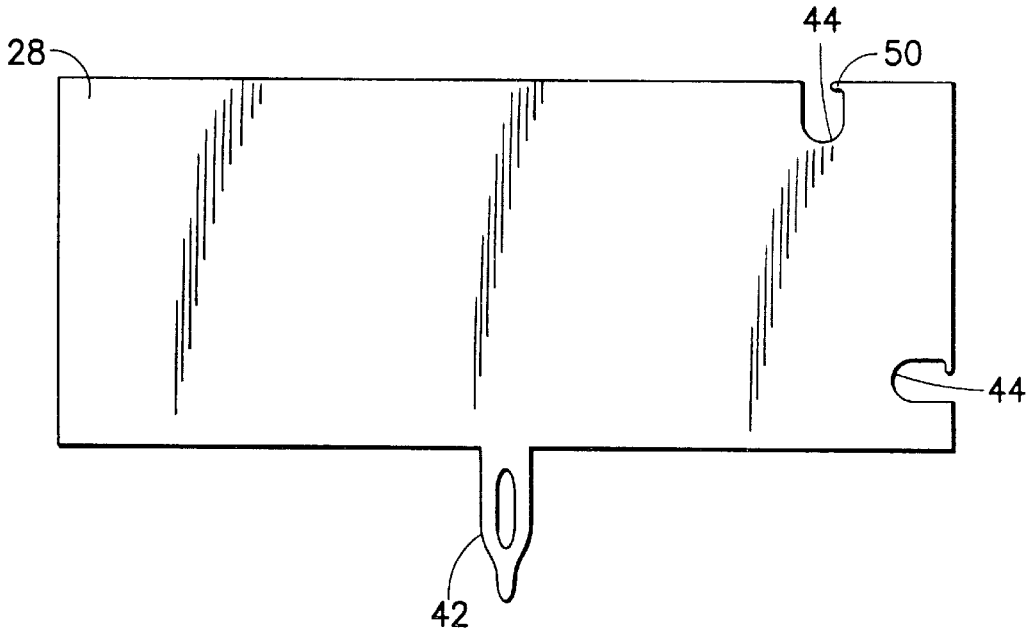
FIG. 6 is a side elevational view of one of the vertical shield members.

Referring also to FIG. 6, the first shield members 28 generally extend from the front of the connector to the back of the connector. Each shield member 28 comprises a press fit solder tail 42 extending from a bottom side. Each shield member 28 also comprises two latch mounting recesses 44 extending into the shield member at a rear side edge 46 and a top side edge 48. In an alternate embodiment, each of shield member could comprise more or less than two latch mounting recesses.

Figure 5:
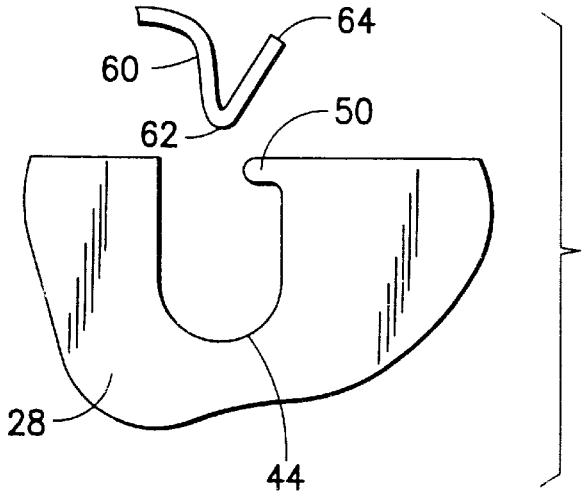
FIG. 5 is an enlarged exploded view of portions of the shields shown in FIG. 1.

Referring also to FIG. 5, the first shield members 28 comprise projections 50 located at the recesses 44. The projections 50 comprise a cantilevered latching projection extending into the recess at an opening into the recess. In an alternate embodiment, the first shield members could comprise any suitable type of latching surface located at the recesses 44.

The second shield member 30 forms a top and rear side shield for the connector 10. The second shield member 30 has a top section 54 which wrap around the top of the connector and a rear section 56 which wraps down over the back side of the connector. The bottom of the rear section 56 comprises press fit solder tails 52. The top and rear sections 54, 56 each comprise a plurality of latches 60.

Figure 7:
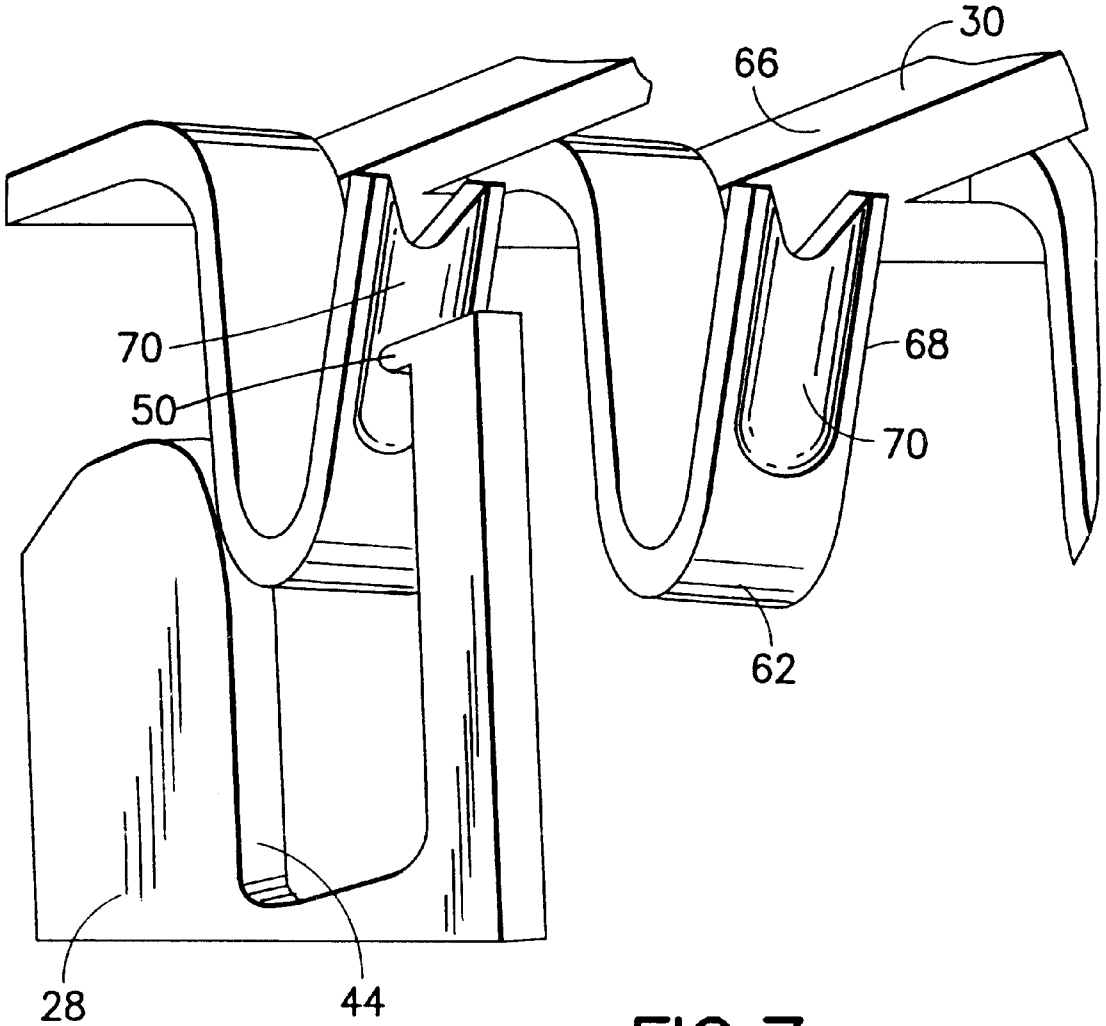
FIG. 7 is an enlarged partial perspective view of the portions of the shields shown in FIG. 5.

Referring also to FIG. 7, in the embodiment shown the latches 60 comprise cantilevered resiliently deflectable hooks. However, in alternate embodiments, any suitable type of shape of a deflectable latch could be provided. The hooks 60 have a general J shape profile. However, in alternate embodiments, the hooks could have any suitable type of shape. Each hook 60 comprises a bottom bend or bight 62 and an end 64. The end 64 comprises a slot 66. In the embodiment shown, the slot 66 comprises a general V shape. However, in alternate embodiments, the slot 66 could have any suitable type of shape. It one type of alternate embodiment, the slot 66 could comprise a through-hole rather than an open sided slot. The slot 66 forms a latch receiving area. The latch receiving areas 66 are sized and shaped for receiving one of the latch projections 50 of one of the first shield members 28. In the embodiment shown, an exterior side of the leg 68 of the hook 60, located between the bend 62 and the end 64, comprises a groove or gusset 70 therealong.

The groove 70 extends from the free end 64 to a tangent point near the bottom curved portion 62 of the J hook 60. In the embodiment shown, the groove 70 has a general curved cross-section. However, in alternate embodiments, the groove 70 could have any suitable type of cross-section including a square or triangular shape. In the embodiment shown, the groove 70 increases in depth along its length between the bend 62 and the receiving area 66. However, in alternate embodiments, the depth of the groove 70 might remain constant along its length. The grooves 70 face the sides of the recesses 44 which have the projections 50 extending therefrom.

During assembly of the connector 10, the contact modules 22 are assembled with the first shield members 28 and attached to the front housing piece 18 to form a subassembly. The second shield member 30 is then attached to this subassembly. During this attachment of the second shield member 30 to the subassembly, the J hooks 60 are inserted into the recesses 44 of the first shield members 28.

As the J hooks 60 are inserted into the recesses 44, the legs 68 of the J hooks 60 contact and ride along the projections 50 at the opening to the recesses 44. The grooves 70 receive the front ends of the projections 50. The grooves 70 function as a guide for maintaining an alignment between the J hooks 60 and the projections 50. As the J hooks 60 are inserted into the recesses 44, the legs 68 of the J hooks deflect inward towards their opposite leg; bending at the bends 62. When the end 64 of the J hooks passes by the bottom of the projections 50, the leg 68 deflects outward from away from its opposite leg resulting in the projections 50 now being located in the receiving areas 66. Because of the V shape of the receiving areas slot 66, portions of the J hook 60 at the end 64 can be located on opposite sides of the projections 50 to prevent the J hooks from laterally moving off of the projections 50. This fixedly attaches the first and second shield members to each other.

The present invention can provide a design enhancement to the J hook latch in the Metral™ receptacle connector or any other electrical connector which uses a deflectable latch for connecting two shield members to each other.

The present invention can improve manufacturability, product integrity, and electrical performance. The design enhancement comprises a gusset or groove which extends from the free end of the latch to a tangent point near the bottom radius portion of the J hook. The purpose of the gusset is to align and capture the edge of the vertical shield when applying the top shield to the assembly. Once properly aligned, the J hook readily seats into its intended latched position. Manufacturability is improved since latches are automatically properly seated. Thus, rework of misaligned latches is eliminated. Proper latching of all J hooks results in a more rigid assembly, hence product integrity is improved. All J hooks being properly latched means that there are a maximum number of interconnections between shields and, therefore, there is an improved electrical performance and an improved signal integrity. In one type of alternate embodiment, the hooks could be located on the first shield members and the recesses could be located on the second shield member.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In a receptacle electrical connector comprising electrical contacts connected to housing members, at least one interior metal shield member located between the housing members, and an exterior metal shield member electrically connected to the at least one interior shield member at a connection, the improvement comprising:

the connection comprising the interior and exterior shield members having a recess and a cantilevered deflectable hook adapted to be inserted into the recess, the hook comprising a receiving area and a groove extending towards the receiving area on an exterior side of the hook, wherein the groove is adapted to guide a projection into the receiving area as the interior and exterior shield members are attached to each other.

2. A receptacle electrical connector as in claim 1 wherein the hook is located on the exterior shield member.

3. A receptacle electrical connector as in claim 1 wherein the hook comprises a general J shape with the receiving area located at an end of the hook.

4. A receptacle electrical connector as in claim 3 wherein the receiving area comprises a general V shape slot.

5. A receptacle electrical connector as in claim 3 wherein the groove extends from a bight in the general J shape to the receiving area at the end of the hook.

6. A receptacle electrical connector as in claim 1 wherein the groove as a general curved cross-section.

7. A receptacle electrical connector as in claim 6 wherein the groove increases in depth along its length.

8. A receptacle electrical connector as in claim 1 wherein the interior shield member comprises the recess and the projection, and the projection comprises a cantilevered latching projection extending into the recess at an opening into the recess.

9. A receptacle electrical connector as in claim 8 wherein the hook comprises a general J shape with the receiving area located at an end of the hook, wherein the groove extends from a bight in the general J shape to the receiving area at the end of the hook, wherein the receiving area comprises a general V shape slot, and wherein the cantilevered latching projection is located in the general V shape slot.

10. An electrical connector comprising:

contact modules comprising electrical contacts connected to housing members;

first metal shield members located between at least some of the contact modules; and a second metal shield member connected to an exterior side of the contact modules, the second shield member comprising deflectable latches extending into recesses in the first shield members, each latch comprising a general J shape with a receiving area at an end of the latch and a groove extending towards the receiving area, wherein each of the first shield members comprise a projection located in one of the latch receiving areas, and wherein the grooves guide the projections into the latch receiving areas as the first and second shield members are attached to each other.

11. An electrical connector as in claim 10 wherein the receiving area comprises a general V shape slot.

12. An electrical connector as in claim 11 wherein the groove extends from a bight in the general J shape to the receiving area at the end of the latch.

13. An electrical connector as in claim 10 wherein the groove as a general curved cross-section.

14. An electrical connector as in claim 13 wherein the groove increases in depth along its length.

15. An electrical connector as in claim 10 wherein each contact module comprises its housing member being overmolded onto its electrical contacts.

16. An electrical connector as in claim 10 wherein the first shield members have a general flat planar shape.

17. An electrical connector as in claim 16 wherein the contact modules have a general flat shape, and the contact modules and first shield members are assembled in an alternating sandwich configuration.

18. A method of assembling an exterior metal shield with an interior metal shield in an electrical connector assembly, the method comprising steps of:

inserting a deflectable latch of the exterior shield into a recess in a side edge of the interior shield;

guiding the latch along a predetermined path into the recess, the step of guiding comprising a groove on the latch sliding along a portion of the interior shield; and locating the portion of the interior shield in a receiving area of the latch, the receiving area being located at an end of the groove.

19. A method as in claim 18 wherein the exterior shield comprises a plurality of the deflectable latches which extend into a plurality of the interior shields.

20. A method as in claim 19 wherein the deflectable latches are located on more than one side of the exterior shield, and the recesses are located in more than one side edge of the interior shields.

* * * * *